US007086446B2

(12) United States Patent
Kollman et al.

(10) Patent No.: US 7,086,446 B2
(45) Date of Patent: Aug. 8, 2006

(54) BREAKAWAY CORD SYSTEM FOR ROLL-UP SHADES

(75) Inventors: Michael Kollman, Madison, WI (US); Adam Ward, Madison, WI (US)

(73) Assignee: Lumino, Inc., Madison, WI (US)

( * ) Notice: Subject to any disclaimer, the term of this patent is extended or adjusted under 35 U.S.C. 154(b) by 201 days.

(21) Appl. No.: 10/748,571

(22) Filed: Dec. 30, 2003

(65) Prior Publication Data

US 2005/0139328 A1 Jun. 30, 2005

(51) Int. Cl.
*A47G 5/02* (2006.01)

(52) U.S. Cl. ..... 160/243; 160/178.1 R; 24/602; 403/275

(58) Field of Classification Search ..... 160/243, 160/84.01, 178.1 R, 173 R, 168.1 R; 24/115 F, 24/462, 602; 403/275, 329
See application file for complete search history.

(56) References Cited

U.S. PATENT DOCUMENTS 1,187,458 A * 6/1916 Hough ..... 160/133
2,631,661 A 3/1953 Nelson
3,246,685 A 4/1966 Anderson et al.
4,909,298 A 3/1990 Langhart et al.
5,485,875 A 1/1996 Genova
5,494,092 A 2/1996 Georgopoulos
5,542,462 A 8/1996 Elsenheimer et al.
5,553,653 A 9/1996 Rozon
5,592,983 A 1/1997 Sartini et al.
5,634,244 A * 6/1997 Fetsch et al. ..... 24/115 F
5,675,875 A * 10/1997 Servatius ..... 24/704.1
5,722,478 A 3/1998 Claypool
6,116,325 A 9/2000 Colson et al.
6,309,134 B1 * 10/2001 Hann ..... 403/326
6,431,248 B1 8/2002 Hyman et al.
6,571,854 B1 6/2003 Palmer et al.
6,585,026 B1 * 7/2003 Su et al. ..... 160/243
6,845,803 B1 * 1/2005 Nien ..... 160/178.1 R
2002/0179790 A1 12/2002 Emrick et al.
2003/0150567 A1 8/2003 Hyman et al.
2004/0194264 A1 * 10/2004 Johansson ..... 24/602

* cited by examiner

*Primary Examiner*—Blair M. Johnson
(74) *Attorney, Agent, or Firm*—Buchanan Ingersoll PC

(57) ABSTRACT

A cord connection device for roll-up shades has a coupling member that fits over a receptive member. The body of the receptive member has a section configured to receive the coupling member in a manner to provide a connection such that when a selected force acts on a cord attached to the coupling member or the receptive member the coupling member will separate from the receptive member. The body of the receptive member can have a second section configured to receive the coupling member in a manner to provide a connection such that the coupling member will not separate from the receptive member or can have a third section configured such that the coupling member will separate when a second selected force acts on the cord or can have all three sections.

22 Claims, 3 Drawing Sheets

BREAKAWAY CORD SYSTEM FOR ROLL-UP SHADES

FIELD OF INVENTION

The present invention relates to a child safety device for window blinds, particularly roll-up shades and shades having such child safety devices.

BACKGROUND OF THE INVENTION

In recent years there has been much concern in the window covering industry about child safety. There have been instances involving pleated shades and venetian type blinds in which a child's head and neck have become entangled in a cord loop that is used to raise and lower, or open and close, the blind and the child was strangled. Consequently, the United States Consumer Product Safety Commission has held hearings and proposed regulations that require looped cords in window covering products to be eliminated or require a device that breaks the loop in the event of entanglement or require a device that envelops or restrains the cord in such a way that a child could not become entangled in the loop.

One popular type of window covering is the roll-up shade. This shade has a panel of window covering material attached at its top edge to a headrail. Roll-up shades have looped cords in which the panel of window covering material is captured. Two or more looped cords extend from the headrail down one side of the panel of window covering material, around the bottom edge of the panel and up an opposite side of the panel of window covering material into the headrail. The cords may then pass through a cord lock in the headrail or wind around a cord collector within the headrail. Movement of the cords into the headrail will cause the panel of window covering material to roll-up and movement of the cords out of the headrail will cause the window covering material to unroll. Although there has never been a reported incident of a child becoming entangled in a roll-up shade, some have observed that the loops in a roll-up shade pose the same danger as cord loops that are used to raise and lower, or open and close, other types of blinds. Consequently, there has been an interest in developing a child safety device for roll-up shades which will prevent a child from becoming entangled in the cord loops that are used to raise and lower the shade material.

Hyman et al. a disclose breakaway cord connection apparatus for roll-up shades in U.S. Pat. No. 6,431,248 and published U.S. patent application No. 2003/0150567 A1. Both references disclose a releasable cord connection apparatus in which the cord is attached to a V-shaped connective member. That connective member is inserted into a recess provided in a receptive member attached to the headrail. When a sufficient force is applied to the cord connected to a connective member, the top of the V-shaped body collapses, allowing the connective member to pass through the recess releasing the connective member and cord from the receptive member. The published application also discloses a breakaway apparatus in which a breakaway end portion on a cord can move along a recessed track and separate from the track when a downward force is applied to the cord. One problem with the breakaway systems disclosed by Hayman et al. is that the cords are always connected to the breakaway apparatus. It is not possible to easily remove the cords from the breakaway apparatus and reattach them to the headrail in a manner so that they will not breakaway. Another problem with this system is that the amount of force that is required to cause the cord to breakaway is determined by the manufacturer and cannot be changed by the user or the installer.

A number of other child safety devices have been proposed for window coverings and have been available in the marketplace. U.S. Pat. No. 5,592,983 to Sartini et al., U.S. Pat. No. 5,542,462 to Eisenheimer et al., U.S. Pat. No. 5,494,092 to Georgopoulos and U.S. Pat. No. 4,909,298 to Langhart et al. disclose breakaway child safety tassels. These patents disclose various tassels to which two or more pull cords are attached. The attachment of multiple cords to a single tassel forms cord loops. The child safety tassels are constructed so that when a force acts on the loop, such as will occur when a child becomes entangled in the cords, the tassel breaks apart, separating the cords and breaking the cord loop or loops. The tassel disclosed by Langhart has been made and sold by Hunter Douglas and others in the industry. In tests of this tassel, some tassels subjected to a force did not break apart when they were supposed to do so. Others broke apart under very little force. Both situations are unacceptable and illustrate the difficulty in producing an effective child safety device for window covering products.

The child safety devices that have been proposed for use on window coverings are all designed to be difficult to remove by the end user. Many window coverings are installed in offices and other windows where small children are never present. Indeed, there are many homes in which there are no small children. Many consumers who purchase window coverings for these locations see no need to have child safety devices on the products that they purchase. Indeed, many such customers have asked that the child safety device not be installed in their product. But, manufacturers and installers are often reluctant to do this for fear of liability, either as a result of a child strangulation or for being in violation of a government regulation. Consequently, there is an unsatisfied demand for a child safety device for window coverings that can be removed or deactivated by the purchaser of the blind.

SUMMARY OF THE INVENTION

We provide a breakaway cord system for breakaway blinds that can be set by the consumer to release under one of two or more forces, preferably four pounds and ten pounds.

We further provide a breakaway cord system that can be easily adjusted by the consumer or owner of the blind so that the cords will not breakaway from the headrail.

We prefer to provide a U-shaped clip to which a lift cord is permanently attached. In a present preferred embodiment the U-shaped clip can be attached to one of three sections of a safety rail. The safety rail is permanently attached to the headrail of the shade. The first two sections of the safety rail are flat and have a bead along the lower edge. The clip fits over the bead and, depending upon the bead size in the selected section, will release upon application of a predetermined force, such as four pounds or ten pounds. The third section has a scored portion that can be removed to create a hole through which the U-shaped clip can be fitted so that the cord will not breakaway from the safety rail. In order to connect the clip to the third portion of the safety rail, the user must punch out the second portion of the rail to provide an opening through which the clip is inserted.

In another present preferred embodiment, the safety rail has two sections. The first section is flat and has a bead along the lower edged. The second section has a cut-out. The clip can be releasably attached to the first section or fitted into the hole formed by removal of the cut-out so that the cord will not breakaway from the headrail.

We also provide a roll-up shade in which the breakaway cord system is provided for each of the looped cords that raise and lower the window covering material. One embodiment has a breakaway cord section that contains a single bead over which the U-shaped clip is fitted.

Other objects and advantages of the present invention will become apparent from a description of the present preferred embodiments shown in the drawings.

DESCRIPTION OF THE PREFERRED EMBODIMENTS

Figure 1:
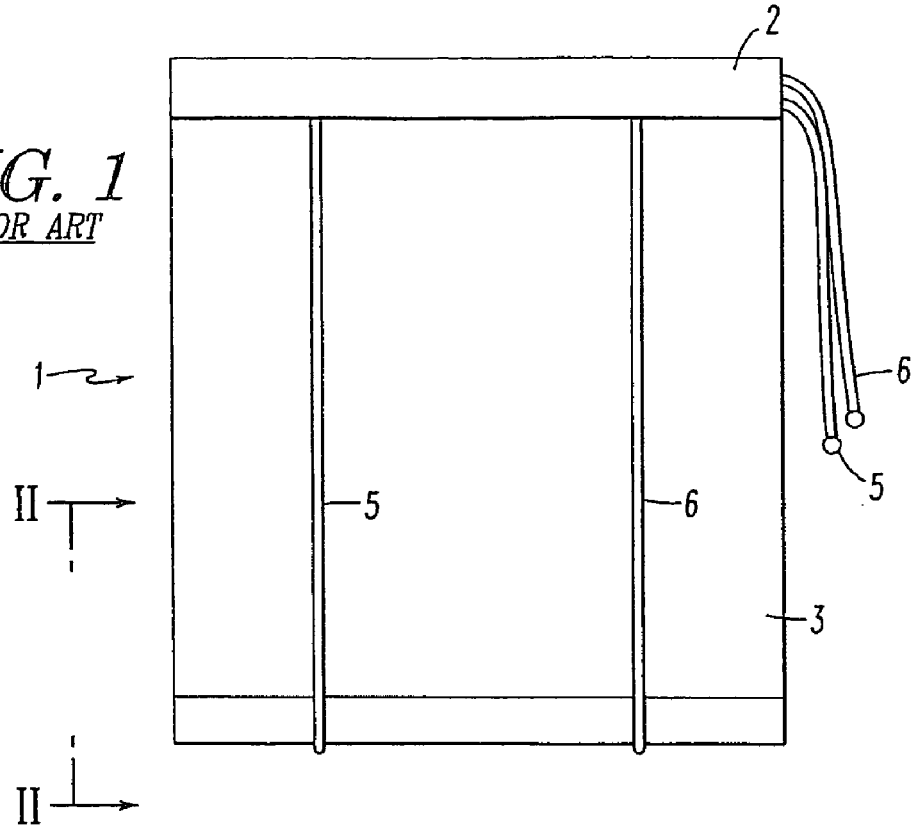
FIG. 1 PRIOR ART
FIG. 1 is a front view of a roll-up shade of the type known in the art.
Figure 2:
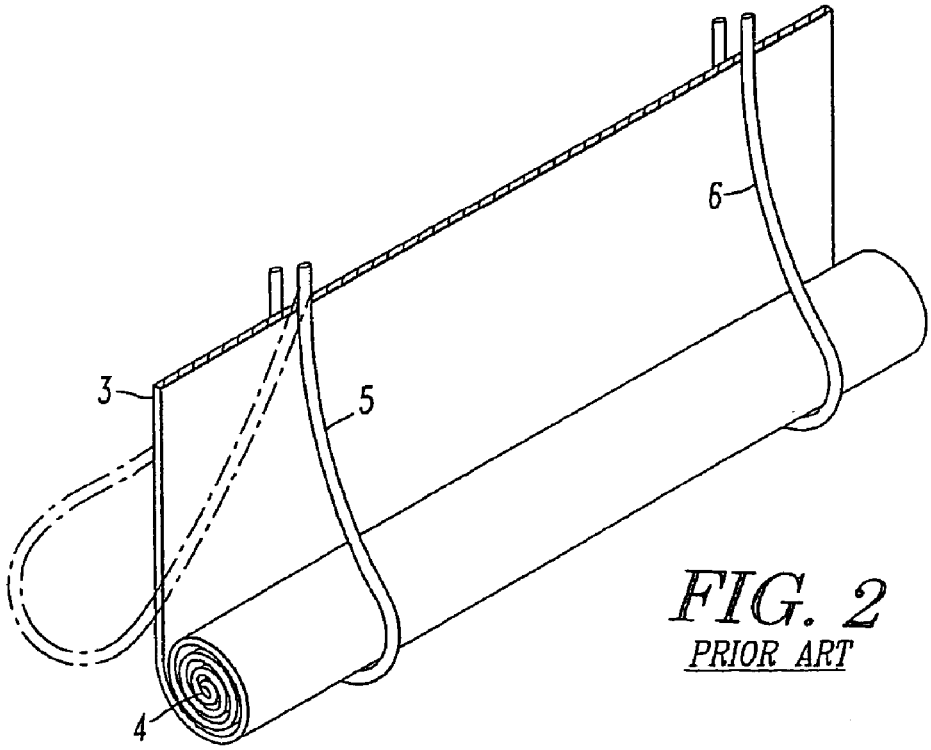
FIG. 2 PRIOR ART
FIG. 2 is a perspective view of a portion of the roll-up shade shown in FIG. 1 viewed along the line II—II in FIG. 1.
Figure 3:
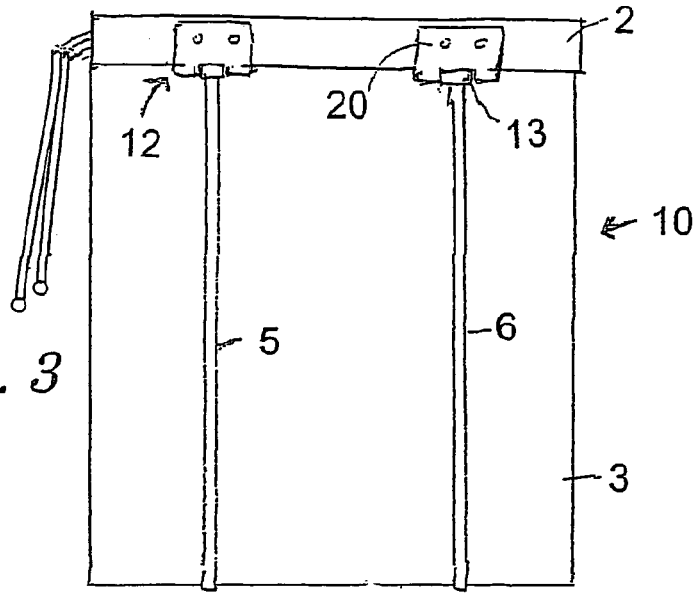
FIG. 3 is rear view of a first present preferred embodiment of our roll-up shade with a breakaway cord system having a coupling member or clip and a receptive member or rail.
Figure 4:
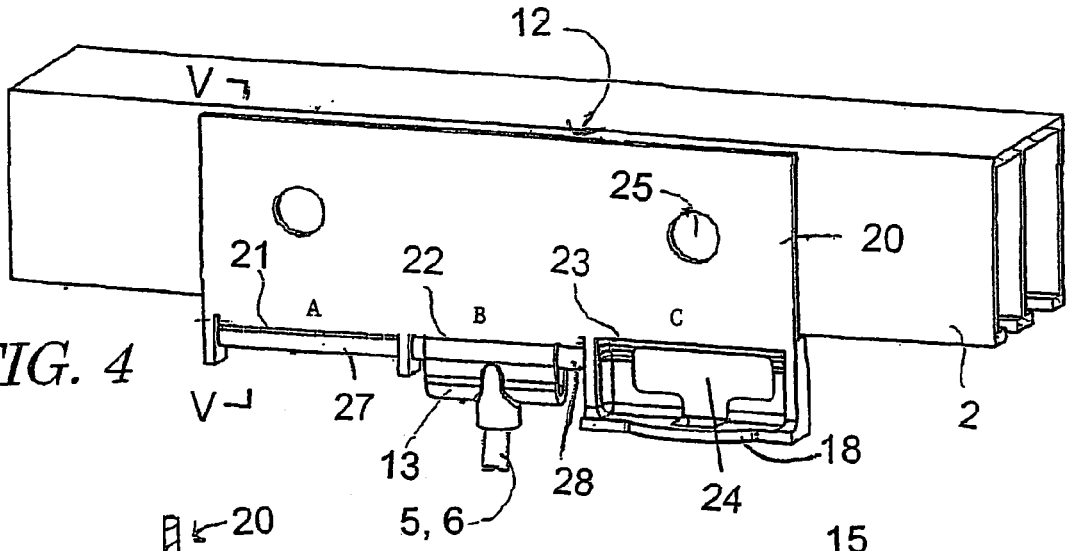
FIG. 4 is a fragmentary view of a portion of the headrail in the embodiment shown in FIG. 3 showing the clip attached to the rail in a manner to separate when a selected force acts on a cord attached to the clip.

A typical roll-up shade is shown in FIGS. 1 and 2. That roll-up shade 1 has a headrail 2 from which window covering material 3 extends. The bottom edge of the window covering material 3 typically has a bottomrail or rod 4 about which the window covering material can be rolled and unrolled. Two or more looped cords 5 and 6 are provided to raise and lower the shade. Each looped cord has one end attached to the headrail. The cord runs down the back surface of the window covering material around the bottom edge and loops back into the headrail. Typically the cords will pass through a cord lock and exit the headrail as shown in FIG. 1. An operator can raise or lower the shade by pulling or releasing the lift cords 5 and 6. Pulling the lift cords causes the window covering material to roll up about a rod 4. Alternatively, the looped cords could be collected on a cord collector within the headrail rather than pass through a cord lock or pulleys. The window covering material may be fabric, woven wood, woven grasses or plastic straws.

In a standard roll-up shade the looped cords 5, 6 can be pulled away from the window covering material as shown in dotted line in FIG. 2. Should a child pull an outermost looped cord away from the window covering material, the child could then become entangled in this free loop.

Figure 5:
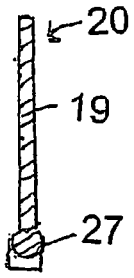
FIG. 5 is a sectional view taken along the line V—V in FIG. 4.

We provide a cord release or breakaway system 12 for roll-up shades 10 which will ; release one end of the looped cords when a selected force acts on the loop as may occur when a child becomes entangled in the cord. As shown in FIGS. 3 through 7, the breakaway system 12 has two basic components, a receptive member and a coupling member. In the embodiment shown in FIGS. 3 through 7 the coupling member is a U-shaped clip 13 to which a lift cord 5, 6 is permanently attached. The lift cord 5, 6 is attached to the clip by passing one end of the cord through the cord channel portion 16 of the clip 13. Then the end of the cord is knotted and captured within the U-shaped body 14. The receptive member is a safety rail or plate 20 which is attached to the headrail 2. In the illustrated embodiment the U-shaped clip 13 can be attached to one of three sections 21, 22 or 23 of the safety rail 20. The safety rail 20 is permanently attached to the headrail 2 of the roll-up shade by an adhesive or by screws 26, shown in FIG. 7, passing through holes 25. The first two sections of the safety rail are flat and have a bead 27, 28 along the lower edge. These sections have a planar body portion 19 having a thickness less than the diameter of the bead as shown in FIG. 5. We prefer that the bead have a circular cross-section. However, the cross-section could be oval, hexagon, octagon or other polygon with the possible exception of the triangle. A triangular shape would work acceptably on the breakaway, but would be difficult to reattach. We chose the circular cross-section for its relative ease of molding. With the other shapes, the oval excepted, there would be corners on the part, which are subject to increased variation in the mold depending on mold pressure, material impurities, and other factors. This could in turn lead to variation in the separation behavior of the male and female parts. The oval shape should theoretically produce the same results as the circular cross section as long as the clip arms are modified to produce the same relative angle to the bead. The clip 13 fits over the bead 27 or 28 and will separate from the safety rail 20 release upon application of a force upon the coupling member. The amount of force required for separation will depend upon the bead size in the selected section. The third section has a scored portion,or punch out 24 that can be removed to create a hole through which the U-shaped clip 13 can be fitted. The hole created when the punch-out is removed can be larger than the clip 13 or can have a height comparable to the height of the clip 13. If the width of the hole is less than the length of the clip, the clip is inserted end first into the hole and then rotated 90° to the position shown in FIG. 7. This clip 13 then rests on the ledge 18 that extends out from section 23. When the U-shaped clip has been fitted through the hole in this way and connected to section 23 of the safety rail 20, the clip and attached cord will not breakaway from the safety rail. In order to connect the clip 13 to the third portion 23 of the safety rail 20, as shown in FIG. 7, the user must first remove the punch-out 24 to provide an opening through which the clip is inserted. We prefer that the safety rail 20 never be sold with the punch-out removed. We further prefer that when the shade is sold the clip be attached to the section 21 which releases under the lowest force.

Both the clip 13 and the rail 20 should be made of the same material, preferably acetal copolymer. They could be made of any one of dozens of other thermoplastics, and possibly metals as well, as long as the geometry of the parts is modified in accordance with the considerations mentioned below to account for the material's mechanical properties and dimensions of the parts.

Figure 6:
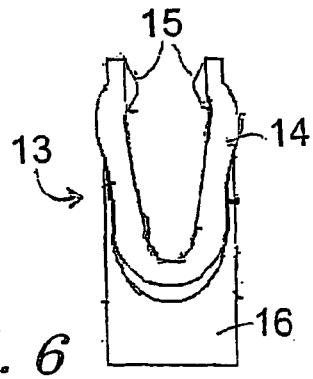
FIG. 6 is an end view of the clip used in the embodiment of FIGS. 3 and 4.
Figure 7:
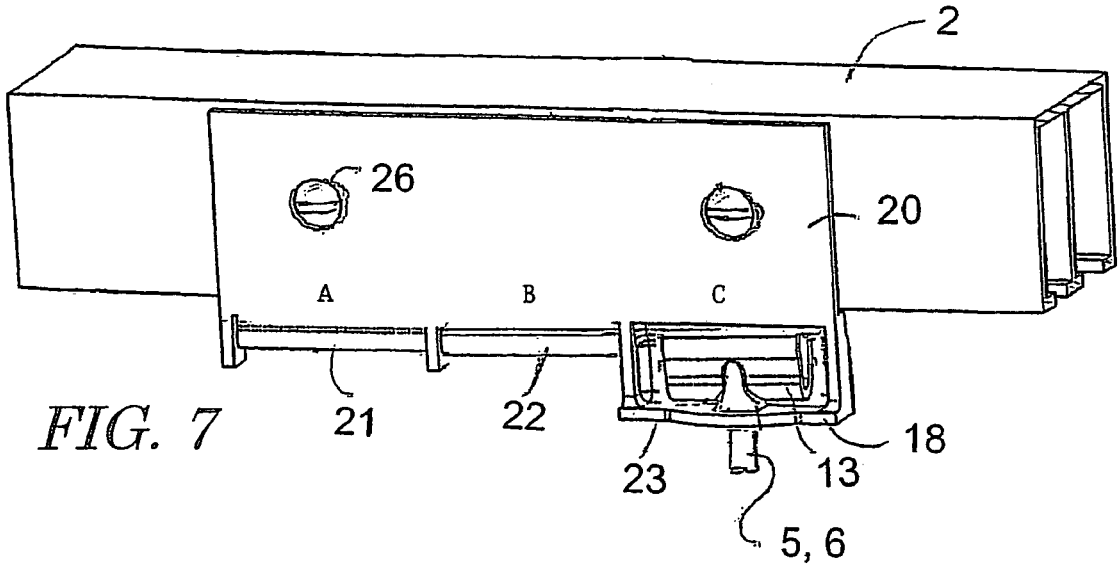
FIG. 7 is a fragmentary view similar to FIG. 4 showing the clip attached to the rail in a manner to prevent breakaway.

We have discovered that when the cord connection device is made of acetal copolymer, a circular bead having a diameter of 0.111 inches will release a clip having a configuration shown in FIG. 6 when the bottom of the loop formed by the cord in a lowered roll-up shade is pulled downward by a force of four pounds. This clip 13 has a U-shaped body 14 with teeth 15 on the opposite inside surfaces near the ends of the clip. The teeth have a height. of 0.0215 inches and are separated by a gap of 0.087 inches. If this same clip is attached to a section which has a circular bead having a diameter of 0.127, the clip will release when ten pounds of force pulls at the bottom of the cord loop.

There are several inter-related material properties and dimensions which determine the breakaway force. These include the flexural modulus of the clip material, tensile yield strength of clip material, coefficient of static friction between the clip and the safety rail, wall thickness of clip arms, length of clip arms, ratio of size of bead cross section to size of clip opening (in its relaxed state), angle formed at bead by clip arm; and overall width of clip (as measured along the length of the bead).

The receptive member or safety rail in the embodiment shown in the drawings has two sections that enable the clip to separate from the receptive member and one section that prevents breakaway. It should be apparent to those skilled in the art that more or fewer sections could be provided that permit separation. If more than one such section is provided, the separation force required by each section should be different. We prefer to provide a breakaway system in which separation occurs at either four pounds or ten pounds. However, our breakaway system can be configured to provide breakaway at lower or higher forces. Whatever forces are selected, we prefer to label each section, as indicated by letters A, B and C in FIGS. 4 and 7. The label may be a word, such as "high" or "low," a letter, or a number that may or may not be equal to the breakaway force required to release the clip from that section. Other symbols, pictures or color codes could be used to identify each section.

Our breakaway system is primarily intended for use in roll-up shades. Nevertheless, our system could be used for awnings, tents having roll-up sides, and other products in which a breakaway cord system is desirable.

In the preferred embodiment the receptive member is attached to the headrail and the coupling member is attached to the a lift cord. Those skilled in the art should recognize that this arrangement could be reversed. The coupling member may be attached to the headrail and the receptive member may be connected to a lift cord.

The coupling member in the preferred embodiment has a U-shaped. opening and a U-shaped outer configuration. The term U-shaped clip as used here, however, is not limited to that configuration. Rather any structure having a U-shaped opening is encompassed by this term.

Although we have described and illustrated certain present preferred embodiments of our breakaway cord system and roll-up shade having such a system, it should be distinctly understood that our invention is not limited thereto, but may be variously be embodied within the scope of the following claims.

We claim:

1. A cord connection device comprising:

a coupling member; and a receptive member, the receptive member comprised of a body having:

a first section configured to receive the coupling member in a manner to provide a connection such that when a selected force acts on a cord attached to either the coupling member or the receptive member the coupling member will separate from the receptive member; and a second section configured to receive the coupling member in a manner to provide a connection such that the coupling member will not separate from the receptive member;

the coupling member being connected to one of the sections of the receptive member; and wherein the first section of the receptive member is comprised of a planar body, the planar body having a thickness and a bottom edge, and an elongated bead running along the bottom edge of the planar body, the bead having a diameter greater than the thickness of the planar body.

2. The cord connection device of claim 1 wherein the coupling member is comprised of a U-shaped clip sized to fit over the bead in the first section of the receptive member.

3. The cord connection device of claim 1 wherein at least one of the coupling member and the receptive member is made form a material selected from the group consisting of thermoplastics and metals.

4. The cord connection device of claim 3 wherein the coupling member and the receptive member are made of acetal copolymer.

5. The cord connection device of claim 1 wherein the second section of the receptive member is comprised of a punch-out section, such that when the punch-out section is removed, the coupling member can be connected to the second section and while the punch-out section is present the coupling member cannot be connected to the second section.

6. The cord connection device of claim 1 wherein the receptive member is further comprised of a third section configured to receive the coupling member in a manner to provide a connection such that when a second selected force acts on a cord attached to the coupling member the coupling member will separate from the receptive member.

7. The cord connection device of claim 6 wherein the selected force is four pounds and the second selected force is ten pounds.

8. A cord connection device comprising:

a U-shaped clip;

a receptive member, the receptive member comprised of a body having:

a first section configured to receive the U-shaped clip in a manner to provide a connection such that when a selected force acts on a cord attached to either the U-shaped clip or the receptive member the U-shaped clip will separate from the receptive member, the first section of the receptive member being comprised of a planar body, the planar body having a thickness and a bottom edge, and an elongated bead running along the bottom edge of the planar body, the bead having a diameter greater than the thickness of the planar body;

a second section configured to receive the U-shaped clip in a manner to provide a connection such that the U-shaped clip will not separate from the receptive member; and a third section configured to receive the U-shaped clip in a manner to provide a connection such that when a second selected force acts on a cord attached to the U-shaped clip the U-shaped clip will separate from the receptive member, the third section of the receptive member being comprised of a planar body, the planar body having a thickness and a bottom edge, and an elongated bead running along the bottom edge of the planar body, the bead having a diameter greater than the thickness of the planar body and greater than the diameter of the bead in the first section;

the U-shaped clip being connected to one of the sections of the receptive member.

9. The cord connection device of claim 8 wherein the second section of the receptive member is comprised of a punch out section, such that when the punch-out section is removed the coupling member can be connected to the second section and while the punch-out section is present the coupling member cannot be connected to the second section.

10. A cord connection device comprising:

a U-shaped coupling member; and a receptive member, the receptive member comprised of a body having:

a first section configured to receive the coupling member in a manner to provide a connection such that when a first selected force acts on a cord attached to either the coupling member or the receptive member the coupling member will separate from the receptive member, the first section being comprised of a planar body, the planar body having a thickness and a bottom edge, and an elongated bead running along the bottom edge of the planar body, the bead having a diameter greater than the thickness of the planar body; and a second section configured to receive the coupling member in a manner to provide a connection such that when a second selected force greater than the first selected force acts on a cord attached to the coupling member the coupling member will separate from the receptive member, the second section being comprised of a planar body, the planar body having a thickness and a bottom edge, and an elongated bead running along the bottom edge of the planar body, the bead having a diameter greater than the thickness of the planar body and greater than the diameter of the bead in the first section;

the coupling member being connected to one of the sections of the receptive member.

11. The cord connection device of claim 10 wherein at least one of the coupling member and the receptive member is made form a material selected from the group consisting of thermoplastics and metals.

12. The cord connection device of claim 11 wherein the coupling member and the receptive member are made of acetal copolymer.

13. A roll-up shade comprising:

a headrail;

a panel of window covering material having a width, a top edge attached to the headrail and a bottom edge;

a plurality of looped cords each cord having a first end and each cord extending from the first end down one side of the panel of window covering material, around the bottom edge and up an opposite side of the panel of window covering material and into the headrail such that movement of the cords into the headrail will cause the panel of window covering material to roll up and movement of the cords out of the headrail will cause the window covering material to unroll, the looped cords spaced apart from one another; and a cord connection device for each looped cord, each cord connection device comprising a coupling member to which one of the first end of the looped cord and the headrail is attached and a receptive member, the receptive member attached to the other of the headrail and the first end of the looped cord, the receptive member comprised of a body having:

a first section configured to receive the coupling member in a manner to provide a connection such that when a selected force acts on the looped cord the coupling member will separate from the receptive member; and a second section configured to receive the coupling member in a manner to provide a connection such that the coupling member will not separate from the receptive member;

the coupling member being connected to one of the sections of the receptive member;

wherein the first section of the receptive member is comprised of a planar body, the planar body having a thickness and a bottom edge, and an elongated bead running along the bottom edge of the planar body, the bead having a diameter greater than the thickness of the planar body.

14. The roll-up shade of claim 13 wherein the coupling member is comprised of a U-shaped clip sized to fit over the bead in the first section of the receptive member.

15. The roll-up shade of claim 13 wherein at least one of the coupling member and the receptive member is made form a material selected from the group consisting of thermoplastics and metals.

16. The roll-up shade of claim 15 wherein the coupling member and the receptive member are made of acetal copolymer.

17. The roll-up shade of claim 13 wherein the second section of the receptive member is comprised of a punch-out section, such that when the punch-out section is removed, the coupling member can be connected to the second section and while the punch-out section is present the coupling member cannot be connected to the second section.

18. The roll-up shade of claim 13 wherein the receptive member is further comprised of a third section configured to receive the coupling member in a manner to provide a connection such that when a second selected force acts on a cord attached to the coupling member the coupling member will separate from the receptive member.

19. The roll-up shade of claim 13 wherein the selected force is four pounds and the second selected force is ten pounds.

20. A roll-up shade comprising:

a headrail;

a panel of window covering material having a width, a top edge attached to the headrail and a bottom edge;

a plurality of looped cords each cord having a first end and each cord extending from the first end down one side of the panel of window covering material, around the bottom edge and up an opposite side of the panel of window covering material and into the headrail such that movement of the cords into the headrail will cause the panel of window covering material to roll up and movement of the cords out of the headrail will cause the window covering material to unroll, the looped cords spaced apart from one another; and a cord connection device for each looped cord, each cord connection device comprising a U-shaped clip to which one of the first end of the looped cord and the headrail is attached and a receptive member, the receptive member attached to the other of the headrail and the first end of the looped cord, the receptive member comprised of a body having:

a first section configured to receive the U-shaped clip in a manner to provide a connection such that when a selected force acts on the looped cord the U-shaped clip will separate from the receptive member, the first section of the receptive member being comprised of a planar body, the planar body having a thickness and a bottom edge, and an elongated bead running along the bottom edge of the planar body, the bead having a diameter greater than the thickness of the planar body;

a second section configured to receive the U-shaped clip in a manner to provide a connection such that the U-shaped clip will not separate from the receptive member; and a third section configured to receive the U-shaped clip in a manner to provide a connection such that when a second selected force acts on a cord attached to the U-shaped clip the U-shaped clip will separate from the receptive member, the third section of the receptive member being comprised of a planar body, the planar body having a thickness and a bottom edge, and an elongated bead running along the bottom edge of the planar body, the bead having a diameter greater than the thickness of the planar body and greater than the diameter of the bead in the first section;

the U-shaped clip being connected to one of the sections of the receptive member.

21. The roll-up shade of claim 20 wherein the second section of the receptive member is comprised of a punch-out section, such that when the punch-out section is removed the U-shaped clip can be connected to the second section and while the punch-out section is present the U-shaped clip cannot be connected to the second section.

22. A roll-up shade comprising:

a headrail;

a panel of window covering material having a width, a top edge attached to the headrail and a bottom edge;

a plurality of looped cords, each cord having a first end and each cord extending from the first end down one side of the panel of window covering material, around the bottom edge and up an opposite side of the panel of window covering material and into the headrail such that movement of the cords into the headrail will cause the panel of window covering material to roll up and movement of the cords out of the headrail will cause the window covering material to unroll, the looped cords spaced apart from one another; and a cord connection device for each looped cord, each cord connection device comprising a U-shaped coupling member to which either the first end of the looped cord or the headrail is attached; and a receptive member, the receptive member attached to the other of the headrail and the first end of the looped cord, the receptive member comprised of a body having:

a first section configured to receive the coupling member in a manner to provide a connection such that when a first selected force acts on the looped cord the coupling member will separate from the receptive member, the first section being comprised of a planar body, the planar body having a thickness and a bottom edge, and an elongated bead running along the bottom edge of the planar body, the bead having a diameter greater than the thickness of the planar body; and a second section configured to receive the coupling member in a manner to provide a connection such that when a second selected force greater than the first selected force acts on the looped cord the coupling member will separate from the receptive member, the second section being comprised of a planar body, the planar body having a thickness and a bottom edge, and an elongated bead running along the bottom edge of the planar body, the bead having a diameter greater than the thickness of the planar body and greater than the diameter of the bead in the first section;

the coupling member being connected to one of the sections of the receptive member.

* * * * *

UNITED STATES PATENT AND TRADEMARK OFFICE

CERTIFICATE OF CORRECTION

PATENT NO. : 7,086,446 B2
APPLICATION NO. : 10/748571
DATED : August 8, 2006
INVENTOR(S) : Michael Kollman and Adam Ward It is certified that error appears in the above-identified patent and that said Letters Patent is hereby corrected as shown below:

Column 6, claim 3, line 2, change “form” to --from--.

Column 7, claim 11, line 36, change “form” to --from--.

Column 8, claim 15, line 18, change “form” to --from--.

Signed and Sealed this

Second Day of January, 2007

JON W. DUDAS
*Director of the United States Patent and Trademark Office*